US005647666A

United States Patent [19]

Narholm et al.

[11] Patent Number: 5,647,666

[45] Date of Patent: Jul. 15, 1997

[54] MIXER INSTALLATION DEVICE

[75] Inventors: Roland I. G. Narholm, Vaxholm; Per G. L. Stjerna, Huddinge, both of Sweden

[73] Assignee: ITT Flygt AB, Solna, Sweden

[21] Appl. No.: 590,844

[22] Filed: Jan. 24, 1996

[30] Foreign Application Priority Data

Feb. 13, 1995 [SE] Sweden ..... 9500495

[51] Int. Cl.[6] ..... B01F 7/00

[52] U.S. Cl. ..... 366/285; 366/314; 366/331

[58] Field of Search ..... 366/279, 331, 366/285, 608, 314

[56] References Cited

U.S. PATENT DOCUMENTS

| | | | |
|---|---|---|---|
| 2,042,006 | 5/1936 | Jackson | 366/608 |
| 3,887,169 | 6/1975 | Maynard | 366/331 |
| 5,368,390 | 11/1994 | Gambrill | 366/331 |
| 5,470,152 | 11/1995 | Rains | 366/331 |

*Primary Examiner*—Robert W. Jenkins
*Attorney, Agent, or Firm*—Menotti J. Lombardi

[57] ABSTRACT

The invention concerns a device for installation of a mixer in a water tank. The mixer is arranged on the inside of a cover (4) in the tank wall (2) which means that only the electric connection means to the motor have to be sealingly drawn through the wall.

2 Claims, 2 Drawing Sheets

MIXER INSTALLATION DEVICE

Figure 1:
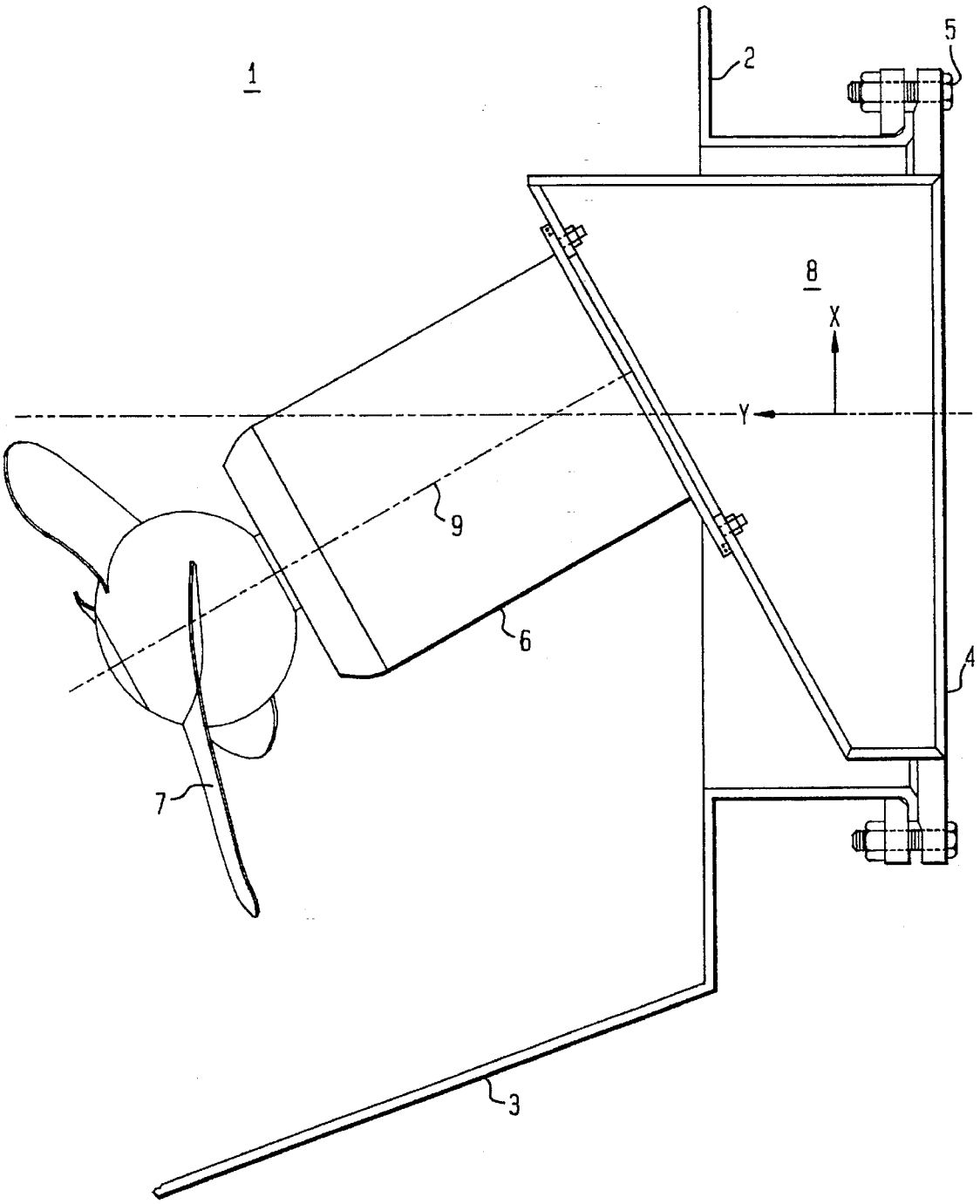
Figure 2:
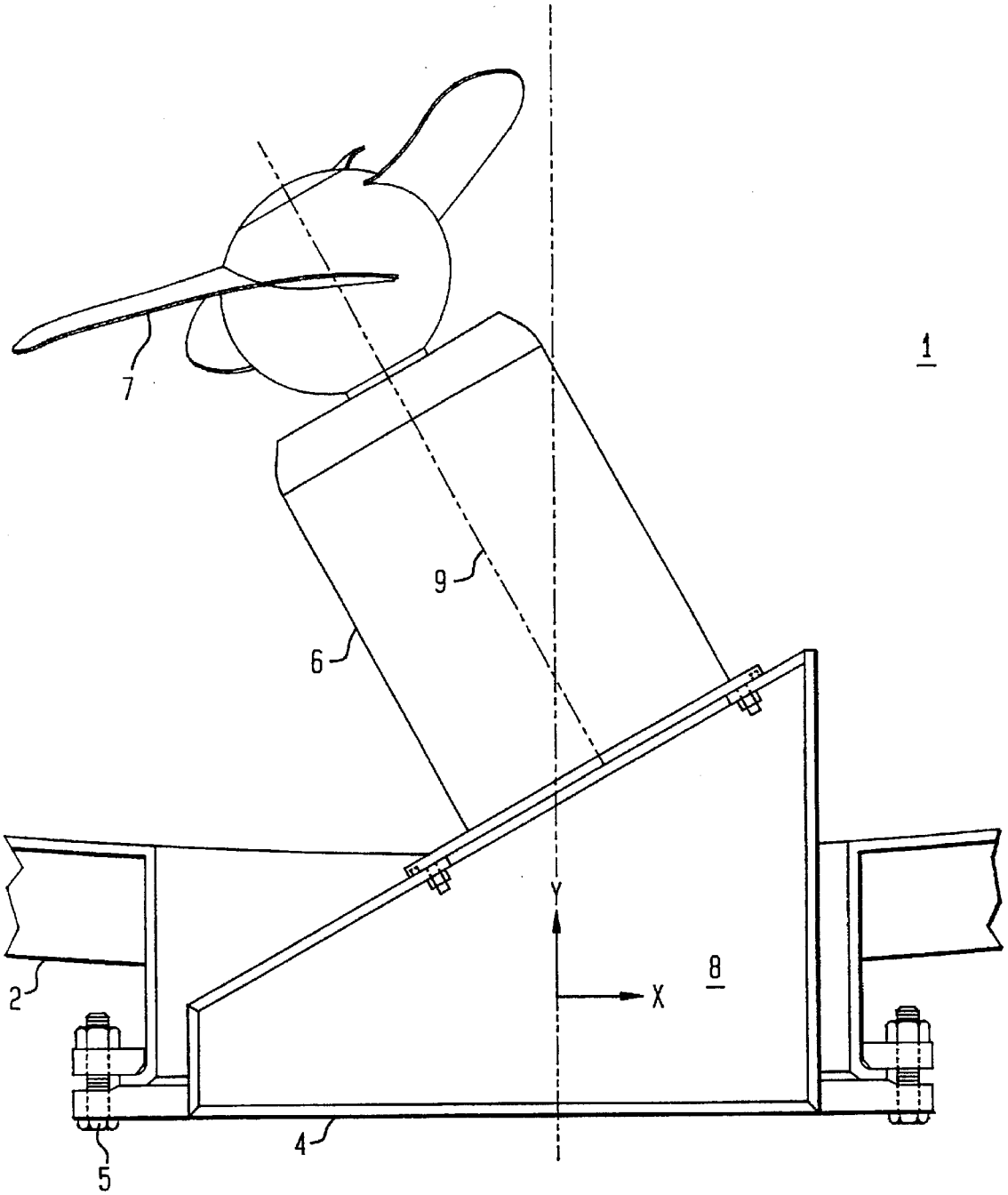

The invention concerns a device for mounting an electrically driven mixer having a rotating propeller in a liquid tank.

Mixers of the above mentioned type are used in various applications within industry, waste water treatment etc, to homogenize liquids used in the industrial process, sewage water etc.

A common mixer comprises an electric motor arranged outside the liquid tank which drives a propeller within the tank via a long shaft, the opening in the tank wall being sealed off by a seal box. Examples of such solutions are shown in DE 1190437 and U.S. Pat. No. 1548935. A disadvantage is that the seal box is expensive and in addition a lot of room is needed when mounting the long shaft. Sometimes security reasons forbid mounting of an electric motor outside the tank if the latter is surrounded by explosive gas.

The German Patent No 828 236 shows a solution where the entire mixer, including the motor, is arranged on the inside of a so-called manhole in a tank wall. This solution solves some of the mentioned problems, but creates cooling problems for the motor.

A way to solve the cooling problem is to use a submersible mixer where the entire unit, including the electric motor, is arranged within the tank. An example is shown in SE 448 116 where the mixer is arranged to be lowered along a guide bar in order to make it possible to raise it for maintenance. A disadvantage is that a lot of room is needed above the tank when mounting, that pollutions may stick to the guide bar and that the reaction force from the propeller, which can be very strong, may cause damage to the tank wall. Thus the attachment must be designed very strong. A variant having a swinging guide bar is shown in SE 449 304.

The purpose with the invention is to obtain an installation of a mixer in a liquid tank which lacks the above mentioned disadvantages.

The invention is described more closely below with reference to the enclosed drawings which show a liquid tank with a mounted mixer from two views.

In the drawings 1 stands for a liquid tank with wall 2 and bottom 3. 4 stands for a cover in the wall 2, 5 locking bolts, 6 a mixer with a propeller 7 and 8 an intermediate part. 9 stands for the propeller shaft.

The liquid tank 1 has normally a so-called manhole 4 on its envelope surface. The cover for said manhole is exchanged by a special cover 4 which preferably is provided with hinges to obtain a simple handling. The end of the mixer is bolted to the inside wall of the cover 4 where a hole is arranged for the electric cable to the motor. When the cover 4 is closed, the entire mixer, including the motor 7, is positioned within the tank. There is thus no need for any expensive seal box, just an inexpensive cable entry.

Between the end of the mixer 6 and the cover 4 an intermediate part 8 is arranged which is so designed that the surface against which the end of the mixer abuts, is oblique relative the manhole 4 and thereby relative the normal through the tank wall 2 in this point. This means that the propeller shaft 9 will make an angle with the tank wall which makes the mixing more efficient. The angle may be up to 45°, preferably 15° to 25°.

Depending on the tank form and the location of the mixer relative the bottom and the liquid surface, it is sometimes appropriate to be able to direct the mixer in various directions, inclined upwards or downwards etc. For that purpose the invention provides for the manhole being possible to mount in different turning positions. In this way any direction can be obtained resulting in an optimum mixing result.

The installation according to the invention provides for many advantages as compared with previously known solutions. Conventional mixers with extended shafts and the electric motor arranged outside the tank demand a lot of room around the tank and an expensive seal box. The cooling of the motor may also be a problem and in addition the surroundings may contain explosive gas which prevents using an outside electric motor.

In comparison with a submersible mixer guided down to its operating position along a bar, the system according to the invention often means a less expensive solution and also that the risk for pollutions getting stuck to the guide bars eliminated. In addition, signals from indicators for measuring temperature, oil-level etc are easy to monitor.

We claim:

1. An installation device for an electrically driven mixer (6) having a rotatable shaft (9) and a propeller (7) mounted thereon, and said mixer (6) being mounted to a cover (4) in a tank wall (2) of a water tank (1) for mixing the contents thereof, wherein the improvement comprises:

said mixer (6) being a submersible type mixer and, with its electrical motor being mounted to the inner side of said cover (4), and said mixer (6) having its electrical connection means passing through or adjacent said cover (4);

said mixer (6) being mounted to said cover (4) by means of an oblique intermediate part (8) such that said shaft (9) forms an angle up to 45 degrees with a normal axis through said tank wall (2); and said cover (4), oblique part (8) and mixer (6) are mountable from outside the tank wall (2) and rotatable with respect to the tank wall (2) so that said angle formed by said shaft (9) and said normal axis of said tank wall (2) is variable.

2. The device according to claim 1, wherein said angle is preferably 15 to 25 degrees.

* * * * *